United States Patent [19]

Bauer

[11] Patent Number: 4,618,183

[45] Date of Patent: Oct. 21, 1986

[54] MULTI-PURPOSE FURNITURE PIECE

[76] Inventor: Karl-Heinz Bauer, Lerchenstrasse 9, D-8740 Bad Neustadt/Saale, Fed. Rep. of Germany

[21] Appl. No.: 815,746

[22] Filed: Dec. 30, 1985

Related U.S. Application Data

[63] Continuation of Ser. No. 502,669, Jun. 9, 1983.

[30] Foreign Application Priority Data

Jun. 15, 1982 [DE] Fed. Rep. of Germany ..... 3222497

[51] Int. Cl.[4] ..... A47C 13/00; A47B 85/00

[52] U.S. Cl. ..... 297/2; 108/12; 182/33; 297/3; D6/480

[58] Field of Search ..... 297/1, 2, 3, 461; 108/11, 12, 13; 182/21, 33, 34, 35; D6/480, 478, 484

[56] References Cited

U.S. PATENT DOCUMENTS

| | | | |
|---|---|---|---|
| 133,169 | 11/1872 | Nurse | 297/3 |
| D. 237,126 | 10/1975 | McDonald | D6/484 |
| D. 248,915 | 8/1978 | Brandenfels | D6/480 |
| D. 260,954 | 9/1981 | Long | D6/480 |
| 1,461,406 | 7/1923 | Stone | 297/1 |
| 2,056,075 | 9/1936 | Roland | 297/2 |
| 2,259,621 | 10/1941 | Dannels | 297/2 |
| 2,269,834 | 1/1942 | Wagner | 297/2 |
| 2,624,393 | 1/1953 | Andrus | 297/2 |
| 2,675,058 | 4/1954 | Meagher | 182/33 |
| 3,744,845 | 7/1973 | Sooker | 108/12 |

FOREIGN PATENT DOCUMENTS

| | | |
|---|---|---|
| 90585 | 6/1896 | Fed. Rep. of Germany . |
| 1825613 | 1/1961 | Fed. Rep. of Germany . |
| 2827393 | 1/1980 | Fed. Rep. of Germany . |
| 1491522 | 7/1967 | France . |
| 1193509 | 6/1970 | United Kingdom . |
| 1353433 | 5/1974 | United Kingdom . |

*Primary Examiner*—William E. Lyddane
*Assistant Examiner*—Mark W. Binder
*Attorney, Agent, or Firm*—Darby & Darby

[57] ABSTRACT

The invention relates to a multi-purpose furniture piece consisting of a rectangular seat plane having two longitudinal sides and two transverse sides, and four legs rigidly connected to the seat plane at the corners thereof and extending perpendicularly thereto. This multi-purpose furniture piece comprising:

two rungs having their ends affixed to the free ends of each two legs located at one longitudinal side, a wall rigidly connected to the seat plane and to the rungs so as to extend perpendicular to the seat plane and parallel to the transverse sides thereof substantially intermediate therebetween, and an end plane affixed to a transverse side of the seat plane and/or to the legs located at this transverse side and being of a smaller dimension in the direction of the legs than the length of said legs.

9 Claims, 4 Drawing Figures

Figure 1:
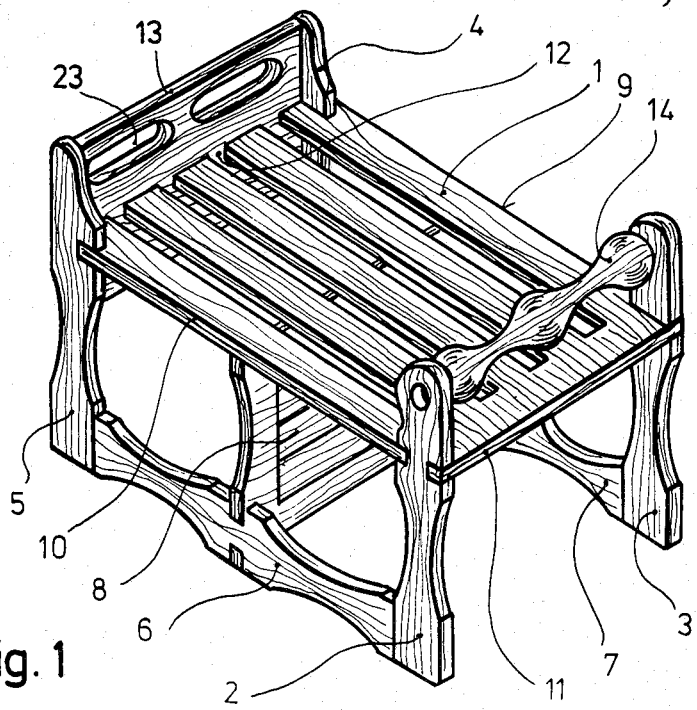

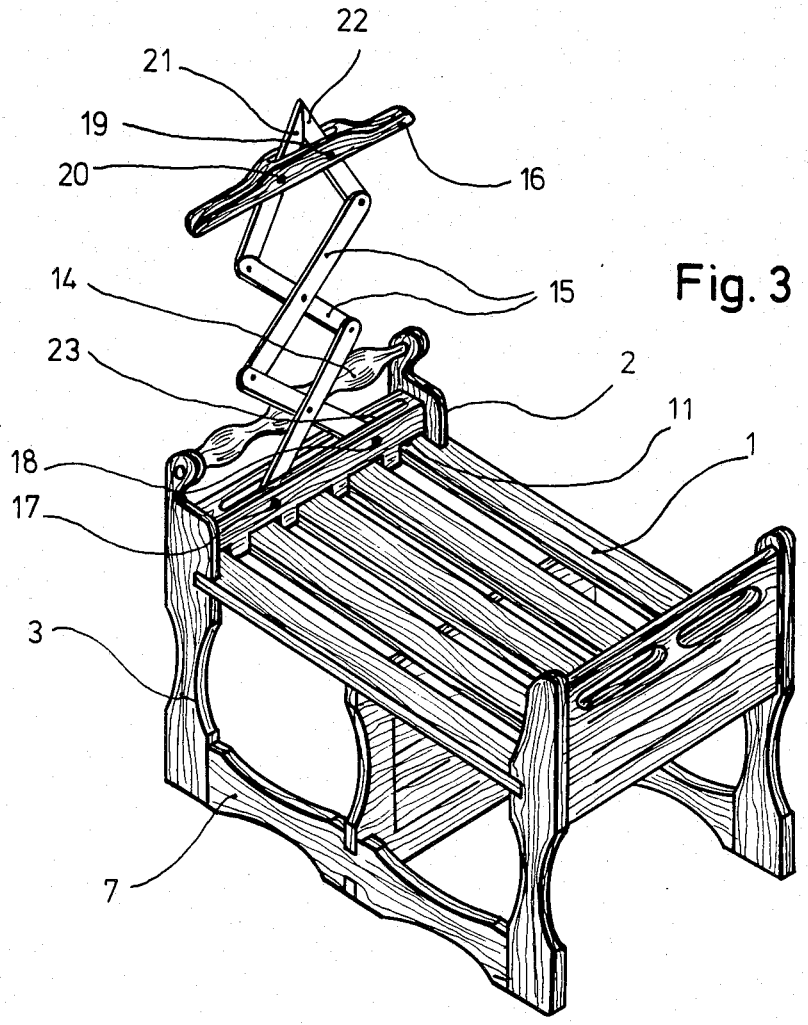
Fig. 3
Fig. 4
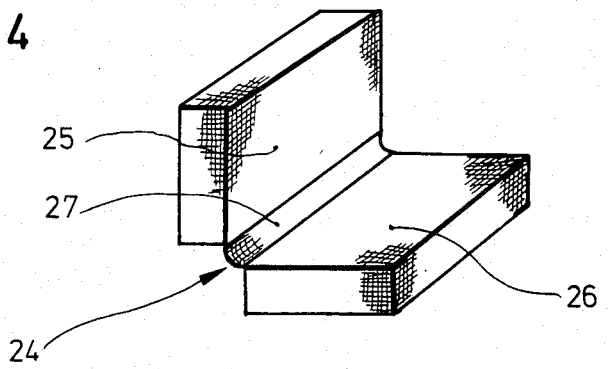

MULTI-PURPOSE FURNITURE PIECE

This is a continuation of application Ser. No. 502,669 filed June 9, 1983.

DESCRIPTION

The present invention relates to a multi-purpose furniture piece.

From frequent use in many households there is already known a piece of furniture consisting of a seat plane having two longitudinal sides and two transverse sides, and four legs rigidly connected to the seat plane at the corners thereof and extending at right angles to the seat plane. This piece of furniture is generally employed as a bench or seat. In addition, a free-standing step ladder and an infant's chair are required in many households. The purchase of a bench or seat, of a step ladder and of an infant's chair involves considerable expense and may result in severe storage problems particularly in the case of restricted living accommodations.

It is therefore an object of the present invention to provide a multi-purpose furniture piece which is of an extremely simple and sturdy construction and lends itself to a large variety of uses.

Accordingly a multi-purpose furniture piece is described.

The multi-purpose furniture piece may be used as a bench or seat in a position in which its rungs rest on the floor. If the multi-purpose furniture piece is set up with the legs opposite the end face recting on the floor, it may be employed as a step ladder. In this case, the wall serves as the lower step, and the end plane as the second, upper step of the step ladder. In this position, the rungs as well as the seat plane are oriented vertically, lending improved stability to the multi-purpose furniture piece in its use as a step ladder. If the multi-purpose furniture piece is set up in a position in which its end plane rests on the floor, it may be used as an infant's chair. In this position the wall acts as the seat plane, the seat plane acts as the back rest, and the legs opposite the end plane act as arm rests. In this manner the described multi-purpose furniture piece that is characterized by a particularly simple and sturdy construction may replace a variety of furniture pieces required in practically every household.

In an advantageous embodiment of the described multi-purpose furniture piece the invention provides that the legs extend from the rungs to points beyond the seat plane. This ensures reliable retention of an upholstery pad adapted to be applied to the seat plane if the multi-purpose furniture piece is employed as a bench or seat. If the multi-purpose furnitur piece is employed as a step ladder, the extended length of the legs opposite the end plane beyond the seat plane contributes to the stable support of the step ladder.

According to a further aspect, the invention provides that the legs located at the transverse side opposite the end face have their ends facing away from the rungs connected to one another by a strut. This strut improves the overall stability of the multi-purpose furniture piece and serves as a handle for setting the multi-purpose furniture piece up in its various positions.

In a further advantageous embodiment the invention provides that the end plane extend in the direction of the legs over substantially equal distances from said seat plane towards the rungs and in the opposite direction, that the end of the end plane opposite the rungs extends coextensive with the ends of the legs affixed thereto, and that the end plane extend to a lesser distance beyond the seat plane away from the rungs than that of the legs located opposite thereto. In use of the multi-purpose furniture piece as a step ladder, this configuration and arrangement of the end plane greatly facilitates mounting of the step ladder. The coextensive arrangement of the end of the end plane with the ends of the legs avoids having projecting edges and corners thereby permitting safe handling of the multi-purpose furniture piece. Due to the fact that the end plane extends to a smaller distance beyond the seat plane in the direction away from the rungs than the legs opposite thereto the multi-purpose furniture piece is very stable and safely supported in use as a step ladder, as it is impossible for the user to transfer his weight to a point beyond the ends of the legs forming the support plane of the step ladder, so that the ladder is safely prevented from tipping over.

A further feature of the multi-purpose furniture piece according to the invention consists of a folding trellis having one of its ends connected by means of two pivot bearings to the end plane, to the strut, or to another member adapted to be rigidly connected to the seat plane, and having its other end connected to a coat hanger by means of two further pivot bearings, locking means being provided for locking the folding trellis in its extended position. In the bench or seat position of the multi-purpose furniture piece, the folding trellis may be locked in its extended position so as to permit the multi-purpose furniture piece to be additionally employed as a coat stand.

According to a further advantageous aspect, the end plane may be provided with at least one grip opening. The grip opening facilitates carrying of the multi-purpose furniture piece and the setting up thereof in its various use positions.

In accordance with a further advantageous feature of the invention, the multi-purpose furniture piece is provided with an upholstery pad of the size of the seat plane, consisting of two pad bodies of substantially equal size, and a fabric hinge connecting the two pad bodies. In the extended position of the upholstery pad, in which the two pad bodies lie side-by-side in a common plane, the upholstery pad serves as a cushion for the seat plane. In another position of the upholstery pad, one of the two pad bodies is pivoted about the fabric hinge relative to the other pad body, so that the two pad bodies enclose a ninety-degree angle therebetween. In this position, the upholstery pad serves as a cushion for the multi-purpose furniture piece in its use as an infant's chair. A snap-engagement body may be connected to the upholstery pad and be adapted to be brought into snap engagement with at least one opening in either the end plane, the strut, or other member attached to the seat plane.

This advantageous feature permits the upholstery pad to be releasably connected to the multi-purpose furniture piece, preventing it from being unintentionally detached therefrom during use as a bench or seat, infant's chair, or step ladder.

Figure 2:
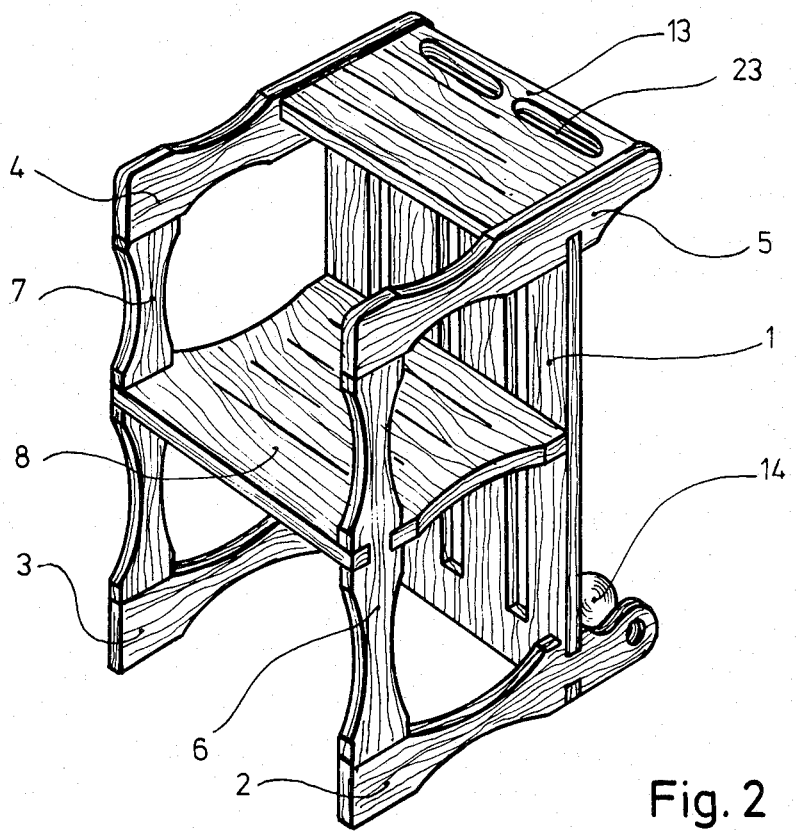

Preferred exemplary embodiments of the invention shall now be described with reference to the accompanying drawings, wherein:

FIG. 1 shows a multi-purpose furniture piece according to the invention in use as a bench or seat, FIG. 2 shows the multi-purpose furniture piece of FIG. 1 in use as a step ladder, FIG. 3 shows a modified embodiment of the multi-purpose furniture piece according to the invention in use as a coat stand, and FIG. 4 shows an upholstery pad for the multi-purpose furniture piece according to the invention.

A multi-purpose furniture piece according to the invention has a rectangular seat plane 1 with four legs 2, 3, 4, 5 rigidly affixed to the corners thereof so as to extend at right angles to seat plane 1. The legs 2, 5 and 3, 4, respectively, located at the same longitudinal side 9, 10 of seat plane 1 have their free ends connected to one another by a rung 6, 7, respectively extending there between and having its ends connected thereto. A wall 8 is rigidly connected to seat plane 1 and rungs 6, 7 so as to extend perpendicularly to seat plane 1 and parallel to its transverse sides 11, and 12 substantially intermediate there between. An end plane 13 is affixed to transverse side 12 of seat plane 1, and to the legs 4, and 5 associated with the respective transverse side 12. The dimension of end plane 13 in the direction of legs 4, and 5 is smaller than the length of the latter. In the direction away from rungs 6 and 7, legs 2, 3, 4, and 5 extend to points beyond seat plane 1. The legs 2, and 3 located opposite end plane 13 have their ends facing away from rungs 6, and 7 interconnected by a strut 14. Strut 14 is a rotatable symmetric lathe-shaped rod having its ends affixed to the ends of legs 2 and 3 so as not to project therebeyond. In the direction of legs 4, and 5, end plane 13 extends from seat plane 1 substantially over the same distance towards rungs 6, and 7 as in the opposite direction. The edge of end plane 13 facing away from rungs 6, and 7 is coextensive with the ends of legs 4, and 5 associated therewith. In the direction away from rungs 6, and 7, end plane 13 extends beyond seat plane 1 over a lesser distance than that of the opposite legs 2 and 3.

In use of the multi-purpose furniture piece as a step ladder, as shown on FIG. 2, wall 8 as well as end plane 13 lie within the support plane defined by legs 2 and 3. The offset arrangement of end plane 13 with respect to wall 8 permits the multi-purpose furniture piece to be readily mounted in its use as a step ladder.

A modified embodiment of the multi-purpose furniture piece of FIGS. 1 and 2 is shown in FIG. 3. In this embodiment, a folding trellis 15 has one end connected by means of two pivot bearings 17, and 18 to a member fixedly supported in recesses formed in seat plane 1. The other end is connected to a coat hanger 16 by means of two further pivot bearings 19, and 20, the coat hanger 16 being formed with a through-opening. The folding trellis is formed in the known manner of a plurality of hinged rod elements connected to one another. In the fully extended position, the free ends of the two outermost rod elements 21, and 22 are lockingly interengaged so as to lock trellis 15 in the extended position. In this position the coat stand formed from folding trellis 15 and coat hanger 16 is able to support the vertical load exerted thereon by clothes hung on coat hanger 16.

Carrying and handling of the multi-purpose furniture piece is facilitated by a pair of grip openings 23 formed in end plane 13.

An upholstery pad 24 shown in FIG. 4 is of substantially the same size as seat plane 1 and consists of two pad bodies 25, 26 connected to one another by a fabric hinge 27. The pad bodies are formed of foam rubber or the like and provided with a fabric envelope. In use of the multi-purpose furniture piece as a bench or seat, upholstery pad 24 is laid onto seat plane 1 with the two pad bodies 25, 26 lying side by side. In use of the multi-purpose furniture piece as an infant's chair, pad body 26 is raised at right angles to pad body 25 to serve as a cushion for the back part, while pad body 25 serves as a cushion for the seat plane now formed by wall 8. Snap engagement means is provided for detachably connecting upholstery pad 24 to the multi-purpose furniture piece. Such snap enagegement means may be in the form of a coiled ribbon connected to upholstery pad 24 and adapted to be received in an opening of end plane 13.

In a modification of the described embodiments, the pairs of interconnected legs 2, 5; 3, 4 and rungs 6, 7 may be replaced by integrally formed U-shaped metal frames. Likewise, rungs 6 and 7 may be of substantially increased width so as to extend into contact with seat plane 1. Seat plane 1, wall 8 and end plane 13 may be formed as grid structures. It is likewise possible to form the multi-purpose furniture piece as an integral structure of a synthetic resin or the like.

I claim:

1. In a multi-purpose furniture piece containing a rectangular seat plane having two longitudinal sides, two transverse sides and four legs extending at right angles to said seat plane, one of said legs being rigidly connected to each corner of said seat plane, at the intersection of a longitudinal side and a transverse side of said seat plane, the improvement which comprises:

(a) two longitudinal rungs, each of said rungs having its outer ends affixed to the free ends of two legs located on the same longitudinal side of said seat plane;

(b) a wall rigidly connected to said seat plane and to said rungs and extending parallel to said first and second transverse sides and vertically to said seat plane, said wall being located at a substantially equal distance from each of said transverse sides, said wall being adapted to serve as a first stepping surface when said furniture piece is oriented in a stepladder position, with two of said legs at an end of said seat plane are substantially horizontal and adjacent a floor surface; and (c) an end plane located at and affixed to one of the transverse sides of said seat plane, said end plane having a smaller dimension parallel to said legs then the length of said legs, said end plane being adapted to serve as a second stepping surface at a height above said first stepping surface when said furniture piece is oriented in said stepladder position.

2. In a multi-purpose furniture piece containing a rectangular seat plane having two longitudinal sides, two transverse sides and four legs extending at right angles to said seat plane, one of said legs being rigidly connected to each corner of said seat plane at the intersection of a longitudinal side and a transverse side of said seat plane, the improvement which comprises:

(a) two longitudinal rungs, each of said rungs having its outer ends affixed to the free ends of two legs located on the same longitudinal side of said seat plane;

(b) a wall rigidly connected to said seat plane and to said rungs and extending parallel to said first and second transverse sides and vertically to said seat plane, said wall being located at a substantially equal distance from each of said transverse sides, said wall being adapted to serve as a first stepping surface when said furniture piece is oriented in a stepladder position, with two of said legs at an end of said seat plane are substantially horizontal and adjacent a floor surface; and (c) an end plane affixed to two legs located on the same transverse side of said seat plane, said end plane having smaller dimension in the direction parallel to said legs than the length of said legs, said end plane being adapted to serve as a second stepping surface at a height above said first stepping surface when said furniture piece is oriented in said stepladder position.

3. The multi-purpose furniture piece of claim 2 wherein said end plane is also affixed to a transverse side of said seat plane.

4. The multi-purpose furniture piece according to claim 2 wherein said four legs extend away from said rungs and terminate at points beyond said seat plane.

5. The multi-purpose furniture piece according to claim 2 wherein the ends of the two legs located on the transverse side of said seat plane opposite said end plane are connected together by a transverse strut located at the end of said legs furthest away from said rungs.

6. The multi-purpose furniture piece according to claim 2 wherein said end plane extends about equal distances above and below said seat plane;

the transverse side of said end plane furthest away from said rungs is coextensive with the ends of the legs furthest away from said rungs, and located on the same transverse side of said seat plane as said end plane; and said end plane extends a shorter distance beyond said seat plane in the direction facing away from said rungs than the length of the opposite transverse legs.

7. The multi-purpose furniture piece according to claim 2 including at least one hand grip is provided in said end plane.

8. The multi-purpose furniture piece according to claim 2 comprising:

an upholstered pad approximately the size of said seat plane and adapted to rest thereon, said pad consisting of two pad bodies of substantially equal size and a fabric hinge interconnecting said bodies.

9. In a multi-purpose furniture piece containing a rectangular seat plane having two longitudinal sides, two transverse sides and four legs extending at right angles to said seat plane, one of said legs being rigidly connected to each corner of said seat plane, the improvement which comprises:

(a) two rungs, each of said rungs having its outer ends affixed to the free ends of two legs located on the same longitudinal side of said seat plane;

(b) a wall rigidly connected to said seat plane and to said rungs and extending parallel to said first and second transverse sides and vertically to said seat plane at substantially equal distance from said transverse sides, said wall being adapted to serve as a first stepping surface when said furniture piece is oriented in a stepladder position, with two of said legs at an end of said seat plane are substantially horizontal and adjacent a floor surface; and (c) an end plane located at and affixed to one of said transverse sides of said seat plane, said end plane having a smaller dimension in the direction parallel to said legs than the length of said legs, and extending for an equal distance above and below the transverse edge of said seat plane and parallel to said legs, said end plane being adapted to serve as a second stepping surface at a height above said first stepping surface when said furniture piece is oriented in said stepladder position.

* * * * *